US008776434B2

(12) United States Patent
Terasaki et al.

(10) Patent No.: US 8,776,434 B2
(45) Date of Patent: Jul. 15, 2014

(54) SIDE SLIDING DOOR APPARATUS FOR VEHICLE

(75) Inventors: Tomio Terasaki, Cliffside Park, NJ (US); Atsushi Kitabata, Suzuka (JP)

(73) Assignee: Fuji Electric Co., Ltd., Kawasaki-shi (JP)

( * ) Notice: Subject to any disclaimer, the term of this patent is extended or adjusted under 35 U.S.C. 154(b) by 30 days.

(21) Appl. No.: 13/067,377

(22) Filed: May 27, 2011

(65) Prior Publication Data

US 2011/0308164 A1 Dec. 22, 2011

(30) Foreign Application Priority Data

May 28, 2010 (JP) ..... 2010-122879

(51) Int. Cl.
*E05C 7/06* (2006.01)

(52) U.S. Cl.
USPC ..... 49/116; 49/118

(58) Field of Classification Search
USPC ..... 49/116, 118, 366, 370; 292/DIG. 46, 292/DIG. 73, DIG. 56, 1, 144, DIG. 21, 23
See application file for complete search history.

(56) References Cited

U.S. PATENT DOCUMENTS

| | | | | |
|---|---|---|---|---|
| 3,378,952 | A * | 4/1968 | Bidelman et al. | 49/360 |
| 4,502,246 | A * | 3/1985 | Minami | 49/322 |
| 4,657,206 | A * | 4/1987 | Matsumoto et al. | 292/173 |
| 5,758,453 | A * | 6/1998 | Inage | 49/118 |
| 5,878,612 | A * | 3/1999 | Mauer | 70/278.2 |
| 6,662,500 | B2 * | 12/2003 | Inage | 49/116 |
| 6,854,399 | B2 * | 2/2005 | Inage | 105/341 |
| 6,941,701 | B2 * | 9/2005 | Inage | 49/449 |
| 2003/0126797 | A1 * | 7/2003 | Inage | 49/118 |
| 2004/0083653 | A1 * | 5/2004 | Delgado et al. | 49/120 |
| 2006/0175143 | A1 * | 8/2006 | Fujita et al. | 187/314 |

FOREIGN PATENT DOCUMENTS

| | | | |
|---|---|---|---|
| JP | 2000-142392 | | 5/2000 |
| JP | 2001150953 | A * | 6/2001 |
| JP | 2002-038786 | | 2/2002 |
| JP | 2002038786 | A * | 2/2002 |

OTHER PUBLICATIONS

Translation of JP 2001150953 A.*
Translation of JP 2002038786 A.*

* cited by examiner

*Primary Examiner* — Katherine Mitchell
*Assistant Examiner* — Scott Denion
(74) *Attorney, Agent, or Firm* — Manabu Kanesaka

(57) ABSTRACT

A side sliding door apparatus for a vehicle includes one of two sliding doors driven by an actuator, and the other moves in conjunction with the one sliding door via a direction converting mechanism. When the sliding door is in a closed condition, a latch rod is inserted into a lock hole to lock the sliding doors in the closed condition. A roller is pushed up on a cam surface when the sliding doors are opened, which releases the locking. An upper level surface of the cam surface forms an inclined surface with a downward gradient, which prevents the roller from unexpectedly going beyond the starting end of the upper level surface and dropping due to vibration or the like being applied to the slider in the unlocked condition, and prevents the locking with the locking mechanism in response to the next sliding door closing command.

8 Claims, 7 Drawing Sheets

SIDE SLIDING DOOR APPARATUS FOR VEHICLE

BACKGROUND OF THE INVENTION AND RELATED ART STATEMENT

The present invention relates to a side sliding door apparatus that opens and closes a side entrance of a vehicle such as an electric railcar.

As the side sliding door apparatus is entrusted with the lives of the passengers, it must not open arbitrarily from a condition in which the doors are closed, regardless of whether the vehicle is in motion or stationary, and it must consistently be maintained in a closed position by a constant pressure in order to prevent the ingress of rain water or wind, to prevent vibration while in motion, and the like. However, it must be easily unlock the apparatus by a manual operation when an emergency situation such as a power cut occurs, the vehicle stops, and the passengers escape from the vehicle. Because of the above points, a high operational reliability is required for the side sliding door apparatus for vehicle. The present inventor has developed a side sliding door apparatus for vehicle that meets this requirement, for which the present inventor has previously filed patent applications (refer to JP-A-2000-142392 and JP-A-2002-038786). The previous invention improves one portion of the side sliding door apparatus for vehicle.

FIGS. 4 to 7 show the side sliding door apparatus for vehicle according to JP-A-2000-142392, and a simple description will be given thereto. FIG. 4 is a front view showing the entire side sliding door apparatus for vehicle, and FIG. 5 is an enlarged view of a main portion thereof. In FIGS. 4 and 5, two sliding doors 1 and 2 are suspended movably by means of movable bodies 4 from a door rail 3 attached horizontally along the side of a vehicle; move in mutually opposing directions to the left and right of the drawings; and open and close the vehicle entrance. The sliding door 1 on the left side of the drawings is driven by a linear motor 5 acting as an actuator coupled to the movable body 4 of the sliding door 1 but, as shown in FIG. 5, a mover 5*a* of the linear motor 5 is engaged so as to be slidable with respect to the movable body 4 for a certain distance x in the opening and closing directions (the left and right directions in the drawings), and a compression spring 6 is inserted between the mover 5*a* and movable body 4. That is, the linear motor 5 is coupled to the sliding door 1 so as to be movable for the certain distance x relative to the opening direction of the sliding door 1.

Meanwhile, the sliding door 2 on the right side moves in conjunction with the sliding door 1 via a direction converting mechanism 7. As shown in FIG. 5, the direction converting mechanism 7 comprises a lower rack 9 coupled to the movable body 4 of the sliding door 1 via a coupling rod 8, an upper rack 11 coupled to the movable body 4 of the sliding door 2 via a coupling plate 10, and a pinion 12 that meshes with the racks 9 and 11 simultaneously. The lower rack 9 and upper rack 11 are slidably guided in the opening and closing directions inside a unit case 7*a* fixed to the vehicle side, and the pinion 12 is supported by a fixed shaft. The direction of the opening and closing movement of the sliding door 1 driven by the linear motor 5 is converted by the direction converting mechanism 7, and the conversion conveyed to the sliding door 2.

FIGS. 6 and 7 show a sliding door locking mechanism 13 installed together with the direction converting mechanism 7, and a push fitting 14 and pull fitting 15 that lock and unlock the sliding door locking mechanism 13, wherein FIG. 6 represents a condition when locked and FIG. 7 a condition when unlocked. In FIGS. 6 and 7, the push fitting 14 and pull fitting 15 are attached to the leading end of the mover 5*a* of the linear motor 5. The push fitting 14 is rod-shaped and is fixed horizontally at one end, and the pull fitting 15 with a hook-shaped leading end is placed on the upper surface of the push fitting 14, and joined by a pin at the base end portion to the push fitting 14 in such a way as to be able to turn in a vertical direction. The pull fitting 15 is biased in an upward direction by a compression spring 16 inserted between the pull fitting 15 and push fitting 14, while a turning in the upward direction is restricted by a headed pin 17 loosely penetrating the push fitting 14 and screwed into the pull fitting 15. Also, a guide fitting 18 that comes into contact with the upper surface of the pull fitting 15 and restricts the upward turning thereof is attached to the leading end of the fixed portion of the linear motor 5.

Next, the locking mechanism 13 comprises a slider 19 slidably guided in the direction of movement of the sliding doors 1 and 2, a back spring 20 formed by a compression spring that biases the slider 19 in the closing direction (leftward in FIG. 6) of the sliding door 2, a latch 21 slidably guided up and down, and a lock spring 22 formed by an extension spring that biases the latch 21 in a downward direction. A cam surface 19*a* formed by an inclined stepped surface, as shown in the drawings, is formed on the upper surface of the slider 19, and an engagement portion 19*b* is provided on the leading end of the slider 19.

Although not shown in detail, the latch 21 comprises a vertical latch rod 24 guided so as to be movable up and down in a guide tube 23 fixed to and supported by the unit case 7*a*, and a frame 25 integrated with the latch rod 24, and a roller 26 that comes into contact with the cam surface 19*a* formed on the slider 19 is turnably attached to the frame 25. The lock spring 22 that biases the latch 21 in a downward direction is stretched between the frame 25 and unit case 7*a*.

FIG. 6 is a condition of this kind of side sliding door apparatus wherein the sliding doors 1 and 2 are closed, and locked in the closed condition. That is, in this condition, the roller 26 drops onto the lower level surface of the stepped surface formed cam surface 19*a*, in conjunction with which the leading end of the latch rod 24 enters into a lock hole 27 of the upper rack 11, stopping the sliding motion of the upper rack 11. As a result of this, the sliding doors 1 and 2, which move in conjunction with the upper rack 11, cannot move, and are locked in the closed position. Also, in this condition, the push fitting 14 runs up against the engagement portion 19*b* of the slider 19, and the hook of the pull fitting 15 is engaged on the engagement portion 19*b*.

Upon providing a sliding door opening command in this condition, the mover 5*a* of the linear motor 5 moves to the left. In the initial stage of this movement, the mover 5*a*, leaving the sliding door 1 in the closed position, moves for the certain distance x to the left while compressing the compression spring 6, at which time the slider 19 is pulled by the pull fitting 15 via the engagement portion 19*b*. At this time, the pull fitting 15 tries to open upward, but cannot open as it is held down by the guide fitting 18.

Herein, when the slider 19 is pulled and moves to the left, as shown in FIG. 7, the roller 26 is pushed along the inclined surface of the cam surface 19*a* up onto an upper level surface (an approximately horizontal surface) 19*c* thereof. Because of this, the latch 21 is lifted up, the latch rod 24 comes out of the lock hole 27, the locking of the upper rack 11 is released, and the sliding doors 1 and 2 are also unlocked. Meanwhile, on the movement distance of the mover 5*a* reaching approximately x, the holding down of the pull fitting 15 by the guide fitting 18 is stopped. As a result of this, the pull fitting 15 turns upward owing to the action of the compression spring 16, and is released from the engagement portion 19*b* of the slider 19. Even after the pull fitting 15 is released, the slider 19 stays in the advanced position owing to the action of the back spring 20, and the roller 26 is held in the condition in which it is pushed up onto the upper level surface 19*c* of the cam surface 19*a*.

After that, when the mover 5*a* moves the sliding door 1 in the leftward direction as far as a predetermined open position, the sliding door 2 also moves in a rightward direction via the rack and pinion mechanism (refer to FIG. 5). By this happening, the opening operation of the sliding doors 1 and 2 is completed. Subsequently, when the sliding door 1 moves in the rightward direction, driven by the actuator in response to a closing command, and eventually reaches the closed position of FIG. 6, the mover 5*a* pushes the slider 19 to the right via the push fitting 14. As a result of this, the roller 26 drops from the upper level surface 19*c* of the cam surface 19*a*, so that the latch rod 24 falls, and enters the lock hole 27 of the upper rack 11. By this means, the locking of the sliding doors 1 and 2 by the latch 21 is carried out.

Although the opening, closing, and locking of the sliding doors 1 and 2 are carried out as heretofore described, a locking detection switch 28 is provided in order to detect whether or not the locking is completed. A magnetic proximity switch is used for the locking detection switch 28, wherein a magnet element 28*a* formed by a permanent magnet is attached to the frame 25 of the latch 21, and a contact element 28*b* incorporating a reed switch is attached to the unit case 7*a*. The locking detection switch 28 is such that, in the locked condition of FIG. 6, a locking completed signal ON is transmitted by the magnet element 28*a* approaching the contact element 28*b*, and in the unlocked condition of FIG. 7, an unlocking OFF signal is transmitted by the magnet element 28*a* rising away from the reference position of the contact element 28*b*. At a time of an emergency release, the latch 21 is pulled up and unlocked by a wire 30 by a handle 29 shown in FIG. 4 being rotated 90 degrees, but this configuration is omitted from the drawing. Refer to JP-A-2000-142392 for details of the side sliding door apparatus for vehicle.

The heretofore known side sliding door apparatus for vehicle described above is such that there is room for further improvement of the following points.

1. When the sliding doors 1 and 2 are unlocked, the slider 19 is pushed to and held in the advanced position by the spring force of the back spring 20 in order to maintain the roller 26 of the latch 21 in the condition in which it is pushed up onto the upper level surface 19*c* of the cam surface 19*a* formed on the slider 19, but when an external force equal to or greater than the spring force is exerted on the slider 19 due to vibration of the vehicle or the like, there is a danger that the slider 19 moves in the locking direction, due to which the roller 26 drops from the upper level surface 19*c* of the cam surface 19*a*, and that for this reason the locking mechanism 13 cannot lock normally in response to the next sliding door closing command.

2. The magnetic proximity switch 28 configured of the magnet element 28*a* and contact element 28*b* is used as the locking detection switch, but the operating position differs slightly between the locking time and unlocking time due to the effect of the hysteresis of the magnet element 28*a*, and position setting when attaching is difficult.

Therefore, an object of the invention is to address these problems, and further increase the operational reliability of the side sliding door apparatus for vehicle by preventing malfunction due to vibration or the like.

An invention that achieves this kind of object is proposed in JP-A-2002-038786.

The invention of JP-A-2002-038786 is such that, in order to prevent malfunction due to vibration or the like, a projection that prevents the dropping of the roller of the latch at the unlocked position of the slider is formed on the upper level surface of the cam surface of the slider.

However, with the invention of JP-A-2002-038786, there is also a problem wherein, when the sliding doors 1 and 2 are unlocked, the roller 26 of the latch 24 goes beyond the projection of the upper level surface of the slider 19, and the noise caused by the impact when the roller 26 drops onto the horizontal portion of the upper level surface (the fixed position in the unlocked condition) is large compared with a case in which there is no projection.

SUMMARY OF THE INVENTION

Therefore, an object of the invention is to obtain a side sliding door apparatus for vehicle wherein this kind of noise does not occur, and that can prevent the slider 19 from moving in the locking direction due to an external force, the roller 26 dropping and the next locking becoming impossible, which is the original object of providing the projection.

In order to achieve the object, according to an aspect of the invention, a side sliding door apparatus for vehicle includes two sliding doors movably held suspended from a horizontal door rail attached to a vehicle, an actuator coupled to one of the sliding doors so as to be movable a certain distance relative to the opening direction of the one sliding door, a direction converting mechanism that converts the direction of an opening and closing movement of the one sliding door and conveys the conversion to the other of the sliding doors, a locking mechanism provided on the direction converting mechanism, and a push fitting and pull fitting provided on the actuator. The locking mechanism comprises a slider supported so as to be slidable in the movement direction of the one sliding door and having a cam surface formed from a stepped surface on an upper surface thereof.

In addition, the apparatus includes a back spring that biases the slider in the closing direction of the other sliding door; a latch that comes into contact with the cam surface of the slider across a roller and moves up and down in accordance with a sliding action of the slider; and a lock spring. The lock spring biases the latch in a downward direction, wherein, on the one sliding door reaching the closed position when closing the sliding doors, the actuator pushes the slider using the push fitting, causing the roller to drop from the upper level surface of the cam surface and locking the sliding doors in a closed condition with the latch. When opening the sliding doors, the actuator that moves a certain distance in the opening direction pulls the slider using the pull fitting, pushes the roller up on to the upper level surface of the cam surface, and releases the locking of the sliding doors with the latch.

In the above structure:

1. the upper level surface of the cam surface formed on the slider is made to have an inclined surface with a downward gradient from a starting end toward a finishing end of the upper level surface (first aspect).

2. According to the first aspect of the invention, a magnet stopper is provided to attract and hold the slider in an unlocked position with a magnet (second aspect).

3. According to the second or third aspect of the invention, a limit switch is provided to detect the unlocking or locking of the sliding doors from the up and down movements of the latch.

According to the configuration of the aspect of the invention, it is possible to achieve the following advantages.

1. According to the first aspect, wherein the upper level surface of the cam surface formed on the slider is made an inclined surface with a downward gradient, even when the slider tries to move against the back spring due to vibration or the like applied from the exterior in the sliding door unlocked condition, the inclination of the upper level surface acts as gradient resistance. Therefore, the roller is prevented from going beyond the starting end of the upper level surface and dropping onto the bottom level surface of the cam surface, which safely prevents the malfunction of the locking mechanism. Moreover, since the upper level surface is a flat, inclined surface with no irregularity, it is possible to smoothly carry out the locking and unlocking operations while suppressing the occurrence of an impact, and the noise of the impact, accompanying the rise and fall of the latch caused by the relative movement of the roller and slider along the cam surface, and the pushing up and dropping movements of the roller.

2. According to the second aspect, wherein the magnet stopper attracts and holds the slider in the unlocked position with a magnet, the slider attracted and held by the magnet stopper does not move even when subjected to vibration or the like, so that the roller does not drop from the upper level surface of the cam surface.

The reliability is further increased by the configurations of the above first and second aspects used together.

3. Meanwhile, according to the third aspect, which provides a mechanical limit switch instead of the heretofore known magnetic proximity switch in order to simplify the position setting of the switch that detects the unlocking or locking of the sliding doors from the up and down movement of the latch, the limit switch has no hysteresis, so that the operational position when locking and unlocking is constant, the position adjustment when attaching is simpler, and operating accuracy increases.

As heretofore described, according to the invention, it is possible to prevent malfunction whereby the locking of the sliding doors becomes impossible due to an external force such as vibration. In addition, the locking detection function becomes more dependable, which increases the operational reliability of the side sliding door apparatus for vehicle.

DETAILED DESCRIPTION OF THE EMBODIMENTS

Figure 1:
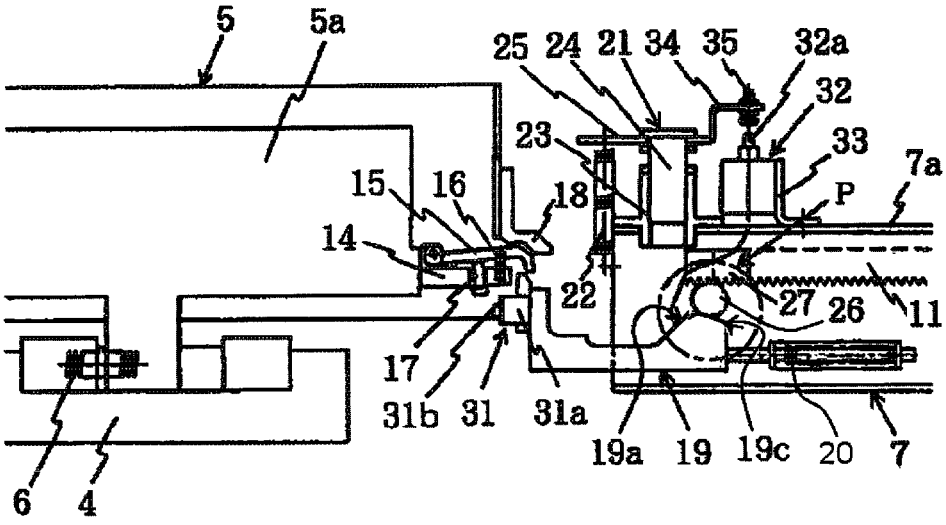
FIG. 1 is a front view of a main portion when a side sliding door apparatus representing an embodiment of the invention is unlocked.

Hereafter, a description of an embodiment of the invention will be explained, based on the working example shown in FIGS. 1 to 3. The same reference numerals are used for portions corresponding to those in the heretofore known structure shown in FIGS. 4 to 7.

Figure 2:
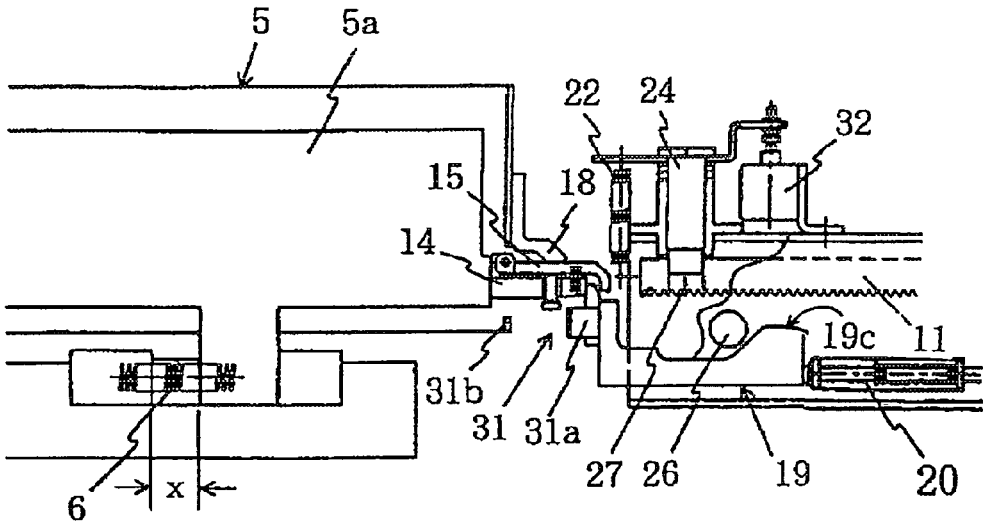
FIG. 2 is front view of a main portion when the side sliding door apparatus representing the embodiment of the invention is locked.
Figure 3:
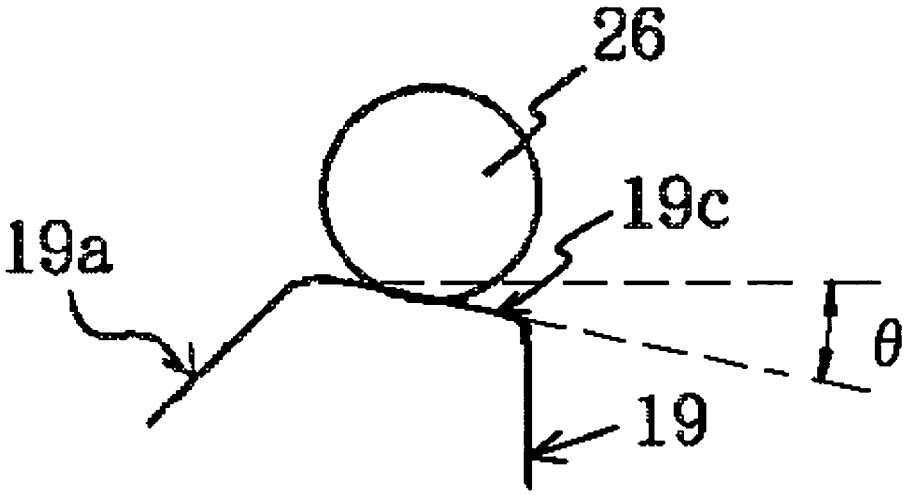
FIG. 3 is an enlarged view of a slider in FIG. 1.
Figure 4:
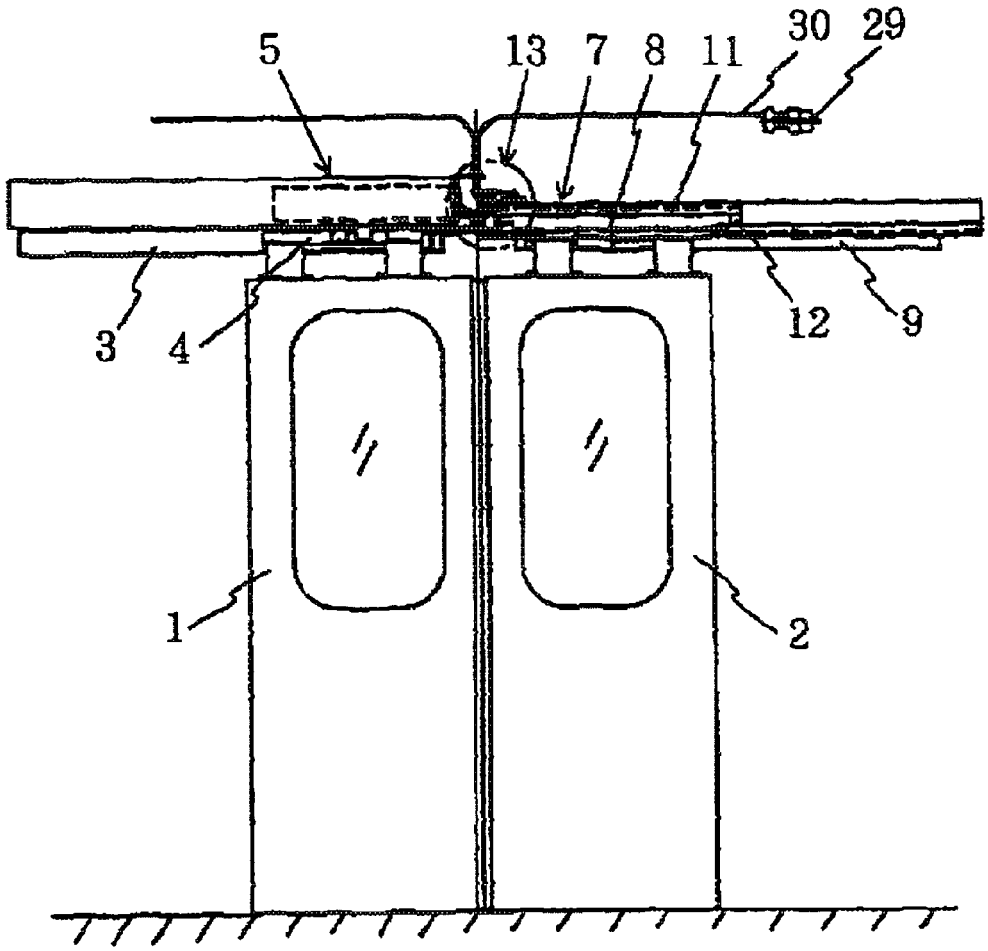
Fig. 4 Prior Art
FIG. 4 is a front view of an overall configuration of a conventional side sliding door apparatus.
Figure 5:
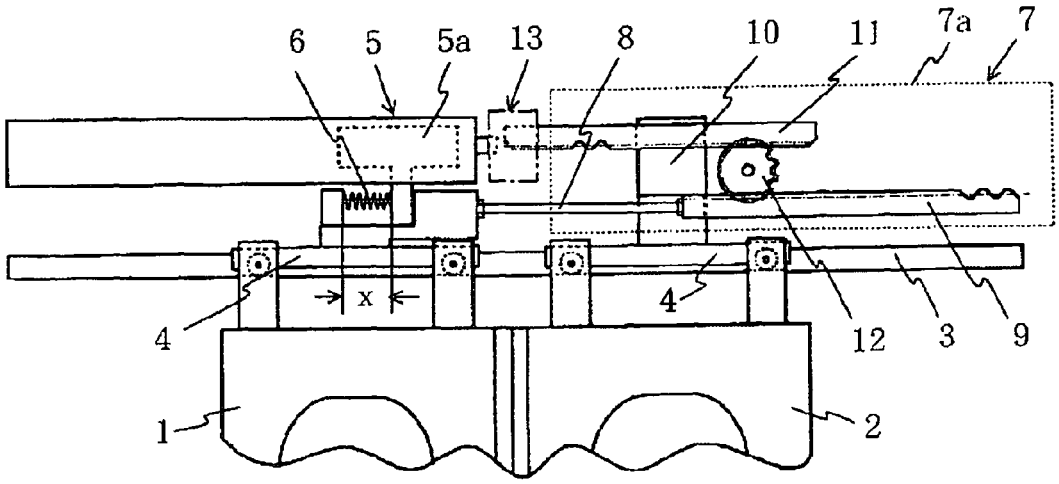
Fig. 5 Prior Art
FIG. 5 is an enlarged view of the main portion of the side sliding door apparatus of FIG. 4.
Figure 6:
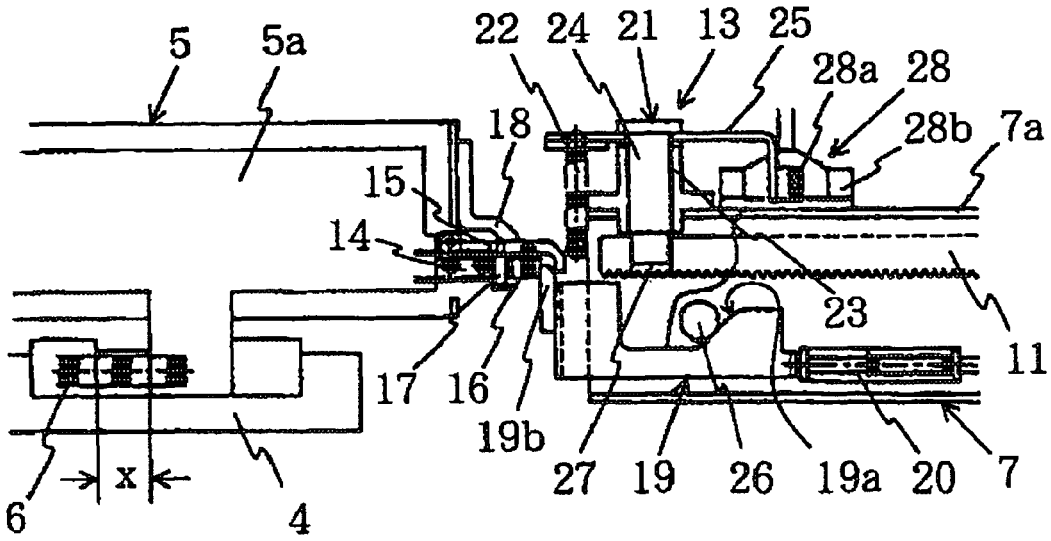
Fig. 6 Prior Art
FIG. 6 is a front view of the main portion showing a locking operation of the side sliding door apparatus of FIG. 4.
Figure 7:
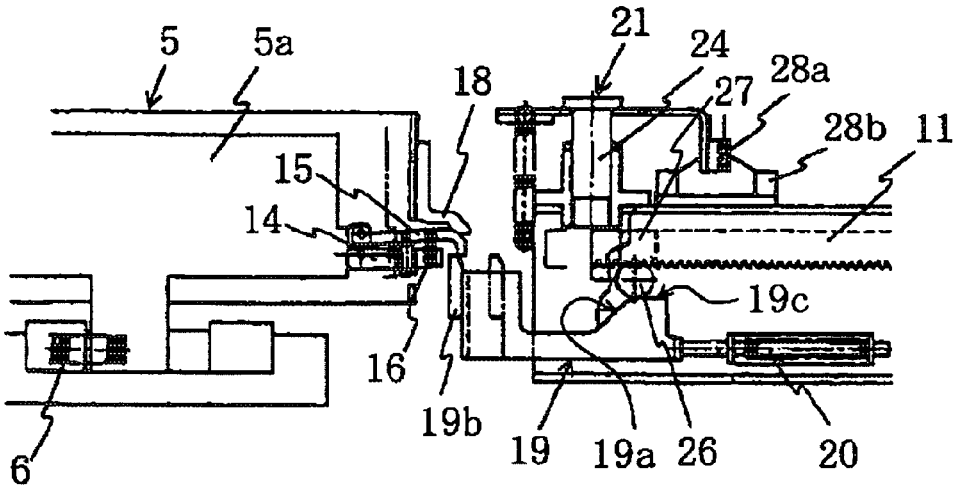
Fig. 7 Prior Art
FIG. 7 is a front view of the main portion showing an unlocking operation of the side sliding door apparatus of FIG. 4.

In FIGS. 1 to 3, a first difference from the conventional structure is that an upper level surface 19*c* of a cam surface 19*a* of a slider 19 is formed in such a way as to be an inclined surface inclined in a downward gradient from a starting end (left side) to a finishing end (right end) of the upper level surface 19*c* (θ in the drawings represents an angle of inclination with the horizontal as a reference) and, in the unlocked position of FIG. 1, a roller 26 is held in a condition in which it is partway along the upper level surface 19*c* having the downward gradient. Herein, by testing and the like, the angle of inclination θ is fixed at an angle in a range of few to around 15 degrees, wherein there is a good balance between a noise reducing effect and operational reliability.

With this configuration, at a time normally locked, the roller 26 goes beyond the starting end of the upper level surface 19*c* and drops onto the bottom level surface of the cam surface 19*a* due to the slider 19 being pushed toward the right by the drive of a linear motor 5, as shown in FIG. 2. Meanwhile, in the unlocked position of FIG. 1, even when an external force such as vibration is exerted on the slider 19, the inclined surface of the upper level surface 19*c* acts as gradient resistance, and the roller 26 is prevented from going beyond the starting end of the upper level surface and dropping unexpectedly. Because of this, it is possible to safely prevent malfunction of a sliding door locking mechanism 13.

Next, as a second difference, a magnetic stopper 31 is provided, which comprises a magnet 31*a* fixed to the leading end of the slider 19 and a fix fitting 31*b* opposing the magnet 31*a*. The fix fitting 31*b* in the drawings is formed by the casing of the linear motor 5. The magnetic stopper 31, in the unlocked position of FIG. 1, attracts and holds the slider 19 on the fix fitting 31*b* with the magnet 31*a*. Because of this, the slider 19 does not move even when subjected to vibration or the like. As a consequence, the roller 26 does not drop from the upper level surface 19*c*.

Furthermore, as a third difference, a mechanical limit switch 32 is used as a locking detection switch. The limit switch 32 is attached with a push button 32*a* on top to a unit case 7*a* of a direction converting mechanism 7 using an L-shaped attachment fitting 33, and a back plate 34 is formed integrally with a frame 25 of a latch 21 in such a way as to oppose the push button 32*a*. An adjustment bolt 35 is mounted on the back plate 34, and the operational position of the limit switch 32 is set by the adjustment bolt 35 in such a way that the limit switch 32 is activated or deactivated according to the depth to which a latch rod 24 enters a lock hole 27 of an upper rack 11. By appropriately setting the operational position of the limit switch 32 when attaching so that there is no fluctuation in the operational position between a locking time (when the push button 32*a* is pressed) and an unlocking time (when the push button 32*a* is released), it is possible to transmit a locking detection signal at a constant operating point.

The disclosure of Japanese Patent Application No. 2010-122879 filed on May 28, 2010 is incorporated herein.

While the invention is explained with reference to the specific embodiments of the invention, the explanation is illustrative and the invention is limited only by the appended claims.

What is claimed is:

1. A side sliding door apparatus for a vehicle, comprising:

two sliding doors movably suspended from a horizontal door rail attached to the vehicle;

an actuator coupled to one of the sliding doors so as to be movable for a certain distance relative to an opening direction of the one sliding door;

a direction converting mechanism that converts a direction of an opening and closing movement of the one sliding door and conveys a conversion to the other of the sliding doors;

a locking mechanism provided on the direction converting mechanism; and a push fitting and pull fitting provided on the actuator;

wherein the locking mechanism comprises a slider supported so as to be slidable in the direction of the movement of the one sliding door and having a cam surface and a rear edge, a back spring that pushes on the rear edge of the slider and biases the slider in a closing direction of the other sliding door, a latch having a roller that contacts the cam surface of the slider and move, and a lock spring that biases the latch in a downward direction, wherein when the one sliding door reaches a closed position at a time of closing the sliding doors, the actuator pushes the slider using the push fitting, causing the roller to drop to a lower portion of the cam surface and locking the sliding doors in a closed condition with the latch, while when opening the sliding doors, the actuator that moves for the certain distance in the opening direction pulls the slider using the pull fitting, pushing the roller up to an upper portion of the cam surface and releasing the locking of the sliding doors with the latch, and wherein the cam surface formed on the slider includes an upper inclined surface extending gradually and continuously upwardly from the rear edge of the slider to a top portion, and an inner inclined surface extending downwardly from the top portion at a side opposite to the upper inclined surface.

2. The side sliding door apparatus for vehicle according to claim 1, further comprising a magnet stopper that attracts and holds the slider in an unlocked position with a magnet.

3. The side sliding door apparatus for vehicle according to claim 1, further comprising a limit switch that detects the unlocking or locking of the sliding doors from the up and down movement of the latch.

4. The side sliding door apparatus for vehicle according to claim 1, wherein the upper inclined surface is formed between the top portion and a finishing end positioned at an upper end of the rear edge extending vertically.

5. The side sliding door apparatus for vehicle according to claim 4, wherein the upper inclined surface is downwardly inclined in a direction from the top portion to the finishing end, and an angle of inclination between the upper inclined surface and a horizontal line is a predetermined angle such that the roller is held on the upper inclined surface when the locking of the sliding doors is released.

6. The side sliding door apparatus for vehicle according to claim 5, wherein the rear edge of the slider is formed vertically to the horizontal line.

7. The side sliding door apparatus for vehicle according to claim 5, wherein the predetermined angle is set in a range from a few degrees to 15 degrees for a noise reducing effect and operational reliability.

8. A side sliding door apparatus for a vehicle, comprising:

two sliding doors movably suspended from a horizontal door rail attached to the vehicle;

an actuator coupled to one of the sliding doors so as to be movable for a certain distance relative to an opening direction of the one sliding door;

a direction converting mechanism that converts a direction of an opening and closing movement of the one sliding door and conveys a conversion to the other of the sliding doors;

a locking mechanism provided on the direction converting mechanism; and a push fitting and pull fitting provided on the actuator;

wherein the locking mechanism comprises a slider supported so as to be slidable in the direction of the movement of the one sliding door and having a cam surface and a rear edge, a back spring that acts on the rear edge of the slider and biases the slider in a closing direction of the other sliding door, a latch having a roller that contacts the cam surface of the slider and moves up and down in accordance with a sliding action of the slider, and a lock spring that biases the latch in a downward direction, wherein when the one sliding door reaches a closed position at a time of closing the sliding doors, the actuator pushes the slider using the push fitting, causing the roller to drop to a lower portion of the cam surface and locking the sliding doors in a closed condition with the latch, while when opening the sliding doors, the actuator that moves for the certain distance in the opening direction pulls the slider using the pull fitting, pushing the roller up to an upper portion of the cam surface and releasing the locking of the sliding doors with the latch, wherein the cam surface formed on the slider includes an upper inclined surface facing upwardly and extending gradually upwardly from the rear edge of the slider to a curved top portion without a horizontal portion thereon, and an inner inclined surface extending downwardly from the curved top portion at a side opposite to the upper inclined surface, and wherein an angle of inclination between the upper inclined surface and a horizontal line is a predetermined angle such that the roller is held on the upper inclined surface and continuously urged toward the rear edge when the locking of the sliding doors is released.

* * * * *

UNITED STATES PATENT AND TRADEMARK OFFICE

CERTIFICATE OF CORRECTION

PATENT NO. : 8,776,434 B2
APPLICATION NO. : 13/067377
DATED : July 15, 2014
INVENTOR(S) : Tomio Terasaki et al.

It is certified that error appears in the above-identified patent and that said Letters Patent is hereby corrected as shown below:

In the Claims

Please change column 7, line 17, "the cam surface of the slider and move, and" to --the cam surface of the slider and moves up and down in accordance with a sliding action of the slider, and--

Signed and Sealed this
Eleventh Day of November, 2014

Michelle K. Lee

Michelle K. Lee
*Deputy Director of the United States Patent and Trademark Office*